US012760542B2

(12) United States Patent
Ferrini

(10) Patent No.: US 12,760,542 B2
(45) Date of Patent: Oct. 13, 2026

(54) REINFORCED POOL STRUCTURE

(71) Applicant: 9257-4607 QUÉBEC INC., Laval (CA)

(72) Inventor: Fabrice Ferrini, Blainville (CA)

( * ) Notice: Subject to any disclaimer, the term of this patent is extended or adjusted under 35 U.S.C. 154(b) by 200 days.

(21) Appl. No.: 18/375,239

(22) Filed: Sep. 29, 2023

(65) Prior Publication Data

US 2025/0109601 A1 Apr. 3, 2025

(51) Int. Cl.
*E04H 4/00* (2006.01)

(52) U.S. Cl.
CPC ..... *E04H 4/0037* (2013.01)

(58) Field of Classification Search
CPC ... E04H 4/0037; E04H 4/0031; E04H 4/0043; E04H 2004/0068
See application file for complete search history.

(56) References Cited

U.S. PATENT DOCUMENTS

| | | | | |
|---|---|---|---|---|
| 11,795,715 | B2 * | 10/2023 | Meyer | E04H 4/0037 |
| 2022/0184859 | A1 * | 6/2022 | Sullivan | E04H 4/0037 |

FOREIGN PATENT DOCUMENTS

| | | | | |
|---|---|---|---|---|
| FR | 2595743 | A1 * | 9/1987 | E04H 4/0037 |
| FR | 2737240 | A1 * | 1/1997 | E04H 4/0037 |
| FR | 2919882 | A1 * | 2/2009 | E04H 4/0037 |
| FR | 3049630 | A1 * | 10/2017 | E04H 4/0037 |

* cited by examiner

*Primary Examiner* — Erin Deery
(74) *Attorney, Agent, or Firm* — Decode Legal Inc.; Charles-Andre Caron

(57) ABSTRACT

A monobloc pool comprising a reinforced structure allowing the pool to feature a bigger reservoir. The pool comprises a floor; walls, adjoining and surrounding the floor, the floor and the walls defining together the reservoir for holding water; and a ledge extending outwardly from the walls. The pool further comprises a reinforcement element adjoining the walls, the reinforcement element defining a closed belt surrounding the walls; and fins scattered around the walls, the fins having and extending vertically between a ground contact face for laying on the ground and a reinforced-element abutting face for abutting the reinforcement element whereby having the fins supporting vertically at least partially the reinforcement element.

14 Claims, 7 Drawing Sheets

REINFORCED POOL STRUCTURE

BACKGROUND

(A) Field

The subject matter disclosed generally relates to swimming pools. More particularly, the subject matter disclosed relates to fiberglass-made swimming pools.

(b) Related Prior Art

In the field of swimming pools, there are two major categories: inground swimming pools, or above-ground swimming pools. Above-ground swimming pools are typically made of posts, a thin wall, a rim connecting the posts, and a liner mounted inside the wall and wedged between the top edge of the wall and the rim. Other alternatives comprise temporary swimming pools and rim-floating swimming pools.

Such types of above-ground swimming pools respond to the design of some customer, but other customers need alternatives which the typical structure of present-day swimming pools does not allow.

There is therefore a need for a novel structure for above-ground swimming pools that may allow a variety of shape and dimensions over what is available nowadays and which can withstand the pressure exerted from water in the above-ground swimming pool.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

SUMMARY

Figure 1:
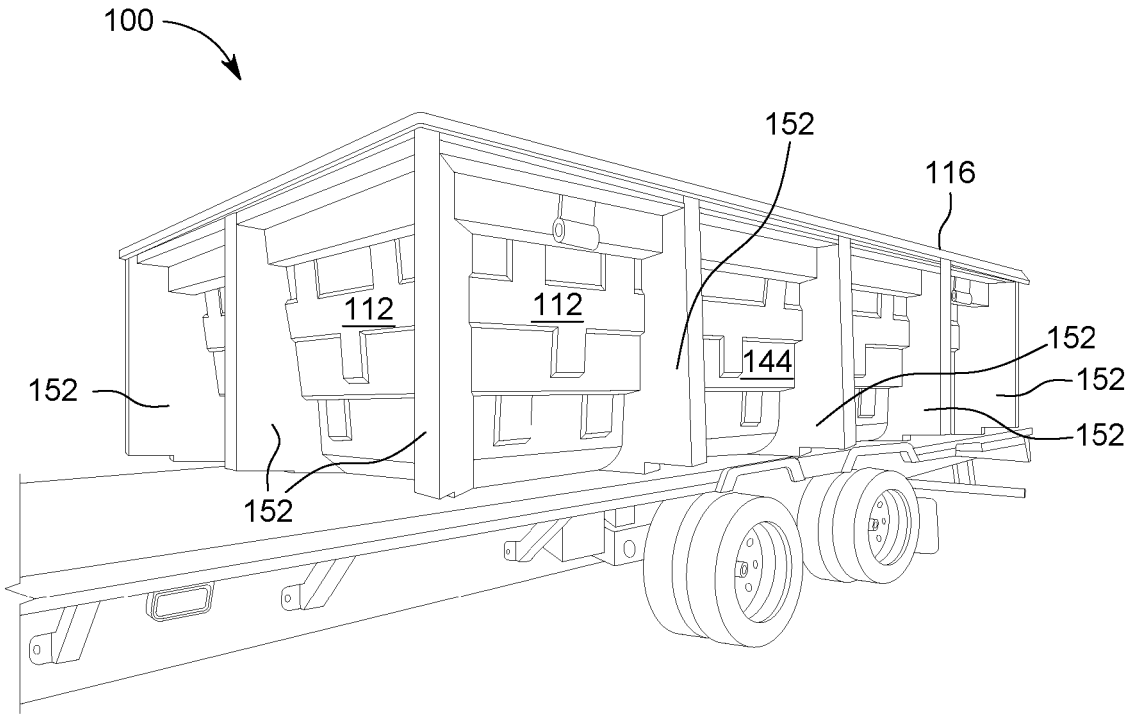
FIG. 1 is a first perspective view of a pool with reinforced structure in accordance with an embodiment.
Figure 2:
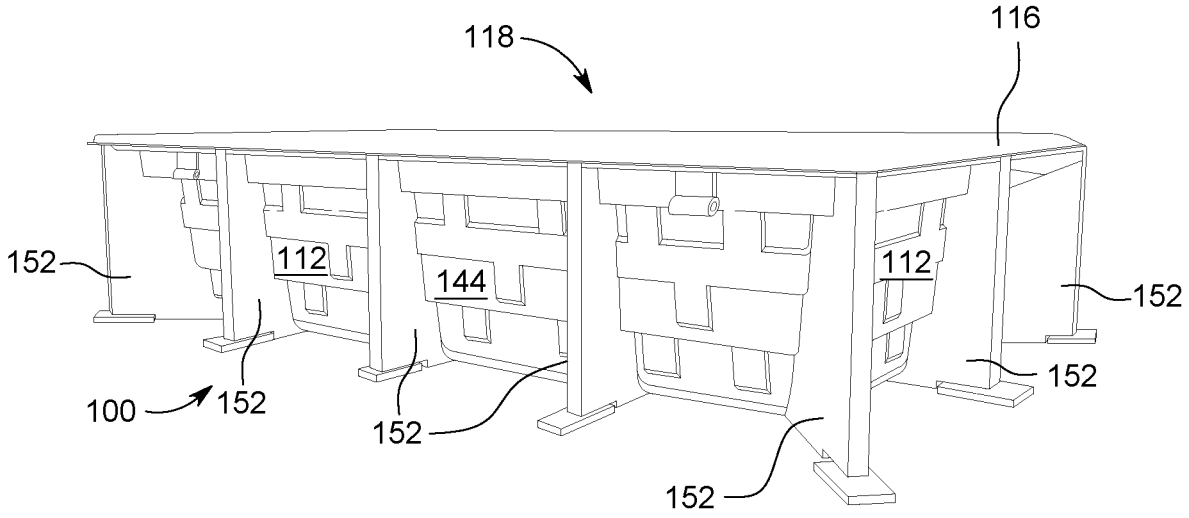
FIG. 2 is a second perspective view of the pool of FIG. 1 installed on concrete blocks.

According to an aspect of the disclosure, there is provided a monobloc pool comprising:

a floor;

a wall, adjoining and surrounding the floor, the floor and the wall defining together a reservoir for holding water;

a reinforcement element adjoining the wall, the reinforcement element defining a closed belt surrounding the wall; and fins distributed around the wall, the fins comprising and extending vertically between a ground contact face for laying on the ground and a reinforcement-element abutting face for abutting against the reinforcement element, thereby having the fins supporting vertically at least partially the reinforcement element.

According to an embodiment, the reinforcement element is made of steel.

According to an embodiment, the reinforcement element is hollow.

According to an embodiment, the wall is made of fiberglass.

According to an embodiment, the wall is made of four wall segments.

According to an embodiment, the pool has a rectangular shape.

According to an embodiment, the walls have a stairs-like shape defining at least two wall sections with a first step in-between.

According to an embodiment, the at least one wall has a first thickness, and wherein the reinforcement element comprises a reinforcement belt made of a section of the walls having a second thickness greater than the first thickness.

According to an embodiment, there are further provided additional reinforcements comprising a downward projection of wall and an upward projection of wall having a second thickness greater than the first thickness, the downward projection of wall and the upward projection not aligned and each perpendicular to the reinforcement belt.

According to an embodiment, the wall is made of a first material, and wherein the reinforcement member is made of a second material that is different from the first material.

According to an embodiment, there is further provided a ledge extending outwardly from the wall, wherein the ledge abuts a top of the reinforcement element.

According to an embodiment, the reservoir may contain a maximum volume of water when the pool is filled to its maximum filling level, and the reinforcement element is positioned at least partially below the maximum filling level.

According to an embodiment, the wall is made of a first material, and wherein the reinforcement element comprises a combination of at least one reinforcement belt made of the first material and a reinforcement member made of a second material different than the first material.

According to an embodiment, the at least one wall comprises two adjoining walls adjoining at a corner, and wherein the fins comprise a corner fin extending at the corner.

According to an embodiment, the corner fin is coplanar with an adjoining plane along which joins the adjoining walls.

According to an embodiment, the fins comprise an intermediary fin extending from and perpendicular to a segment of wall extending between adjacent corners of the pool.

According to an embodiment, the reservoir may contain a maximum volume of water when the pool is filled to its maximum filling level, and wherein the fins are adjoining the wall between about the floor and about the maximum filling level.

According to an embodiment, the at least one wall comprises at least one step extending about one of a top edge and a bottom edge of the reinforcement element.

According to an embodiment, the wall has a generally sloped shape with the reservoir covering a smaller area at a first height about the floor than at a second height farther from the floor.

According to an embodiment, the reinforcement element is enclosed inside a material forming the wall.

DETAILED DESCRIPTION

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about", "approximately", or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as", or the like) provided herein, is intended merely to better illuminate the exemplary realizations and does not pose a limitation on the scope of the realizations. No language in the specification should be construed as indicating any unclaimed element as essential to the practice of the realizations. The use of the term "substantially" is intended to mean "for the most part" or "essentially" depending on the context. It is to be construed as indicating that some deviation from the word it qualifies is acceptable as would be appreciated by one of ordinary skill in the art to operate satisfactorily for the intended purpose.

In the following description, it is understood that terms such as "first", "second", "top", "bottom", "above", "below", and the like, are words of convenience and are not to be construed as limiting terms.

The terms "top", "up", "upper", "bottom", "lower", "down", "vertical", "horizontal", "interior" and "exterior" and the like are intended to be construed in their normal meaning in relation with normal installation of a pool.

It should further be noted that for purposes of this disclosure, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be noted that throughout the appended drawings, like features are identified by like reference numerals.

Referring now to the drawings provided through FIGS. 1 to 5, an above-ground swimming pool, or more simply a pool 100 made of, preferably but without limitation, fiberglass has a non-circular shape, preferably a rectangular shape, and a reinforced structure allowing the pool 100 to be built to hold a volume of water exceeding the volume of water such a swimming pool could hold without the reinforced structure.

The pool 100 in its exemplary rectangular shape comprises four walls 112 and a floor 114 forming together the reservoir 118 (applicable to any pool shape) designed to hold water in the pool 100. The wall may refer, as a whole, to the plurality of wall segments or simply walls 112, forming an enclosure. The wall and the floor 114 are preferably made of the same material, preferably fiberglass, and are manufactured as a single piece continuous structure featuring no connection but rather modifications in orientation as and the floor 114 raises at its peripheries to form the four walls 112. The same applies to the junction of the walls changing direction at their edges to form the adjoining wall 112.

The pool 100 further comprises a ledge 116 with the walls extending outwardly at their top edge to form the ledge 116.

Thereby, the walls 112, the floor 114 and the ledge 116 define an interior surface 142, normally processed such as defining a smoot surface, and an exterior side surface 144 normally hidden once the pool 100 is installed.

The pool 100 has a water-holding periphery 122 defined by the maximum water-holding limit of the interior surface 142, and a ledge periphery 124 defined by the external limit of the ledge 116 beyond the water-holding periphery 122.

The exterior side surface 144 normally extends below the ledge 116 periphery 124 and not beyond ledge periphery 124, that is inwards or equal to the outer limit of the ledge 116 at that position, allowing to have the exterior side surface 144 hidden and the hiding material potentially extending about the ledge 116.

The exterior side surface 144 comprises a plurality of fins 152 distributed around the pool 100 and each outwardly extending away from the exterior side surface 144. The fins 152 are typically peripherally distributed around the pool 100 with one corner fin 154 located at each corner and extending at about equal angle from the joining walls 112, and zero, one or more intermediary fins 156 extending outwardly from the straight edge section of each of the walls 112 (not from the corner, but from the wall segment extending between two adjacent corners). Typically, the number of one or more intermediary fins 156 is determined based on needs, particularly based on the length of the straight section of each wall.

The fins 152 typically comprises a junction edge 162 adjoining the walls 112, a first top edge 164 adjoining the ledge 116, an inner bottom edge 166, an outer bottom edge 168 and an outer edge 170. The junction edge 162 is designed to participate with the wall 112 in accrued resisting to outward pressure exerted by the water over the walls 112 inside which the water exerts its pressure outwardly. The first top edge 164 is designed to provide support for the ledge 116. The inner bottom edge 166 is designed to abut against the ground. The outer bottom edge 168 is designed to be laid over a structural surface, e.g., concrete blocks 202, for leveled installation of the pool 100 and necessary stability. The outer edge 170 provides a surface, preferably a regular surface when considering the combination of the fins 152 against which may be installed a hiding wall for hiding the exterior side surface 144 of the pool 100 once installed.

The pool 100 features a reinforcement member 182 surrounding the interior surface 142 about the water-holding periphery 122, and preferably below and about the higher level of water the pool 100 is designed to hold.

In a preferred embodiment, the reinforcement member 182 comprises (or, in selected embodiments, may even consist of) rectangular-shaped, beams 184, which can advantageously be hollow, can be made of steel (for example and without limitation) or other material having appropriate characteristics and life cycle, extending over the whole length of each of the walls 112 and joined with each other (for example and without limitation, they can be welded), to define a belt-like structure able to resist to outward pressure exerted by the water held in the pool 100. According to an embodiment, the reinforcement element is enclosed inside a material forming the wall 112 of the pool 100.

In a preferred embodiment, the beam 184 comprises a top face 186, a bottom face 188, an inner face 190 facing the adjoining wall 112, and an outer face 192. Regardless of the dimensions of the beams 184, the beams 184 is typically mounted such that its bottom face 188 is lower than the maximum level of water.

In a preferred embodiment, the reinforcement member 182 takes integral part of the pool 100, with the fiberglass used to make the walls 112 being applied over the reinforcement member 182 as well, Therefore, the interior surface 142 extends over the inner face 190 of the beam 184, and the exterior side surface 144 extends over the outer face 192 of the beam 184. Furthermore, the fins 152 feature a second top edge 172 abutting and supporting the bottom face 188 of the beam 184, thereby having the weight of the reinforcement member 182 at least partially supported by the fins 152.

According to an embodiment, the walls 112 of the pool 100 feature a plurality of sections, taking the shape of a stairs-like surface. According to an exemplary embodiment, the walls 112 extend about vertically from their junction to the floor 114 to a first step 174 over a first height, e.g., 42 cm, about horizontally over a first length, e.g., 10 cm, about vertically over a second height to a second step 176, e.g., 69 cm, about horizontally over a second length, e.g., 10 cm, and about vertically over a third height, e.g., 28 cm. The ledge 116 extends beyond its junction to the wall 112 over a fourth distance of e.g., 20 cm.

The interior surface 142 is designed to provide an edge-free surface other than the stairs-like shape discussed before. Step edges and junctions are rounded to provide no undesired shapes, e.g., edges.

Correspondingly, the exterior surface 144 features the same stairs-like geometry.

Figure 3:
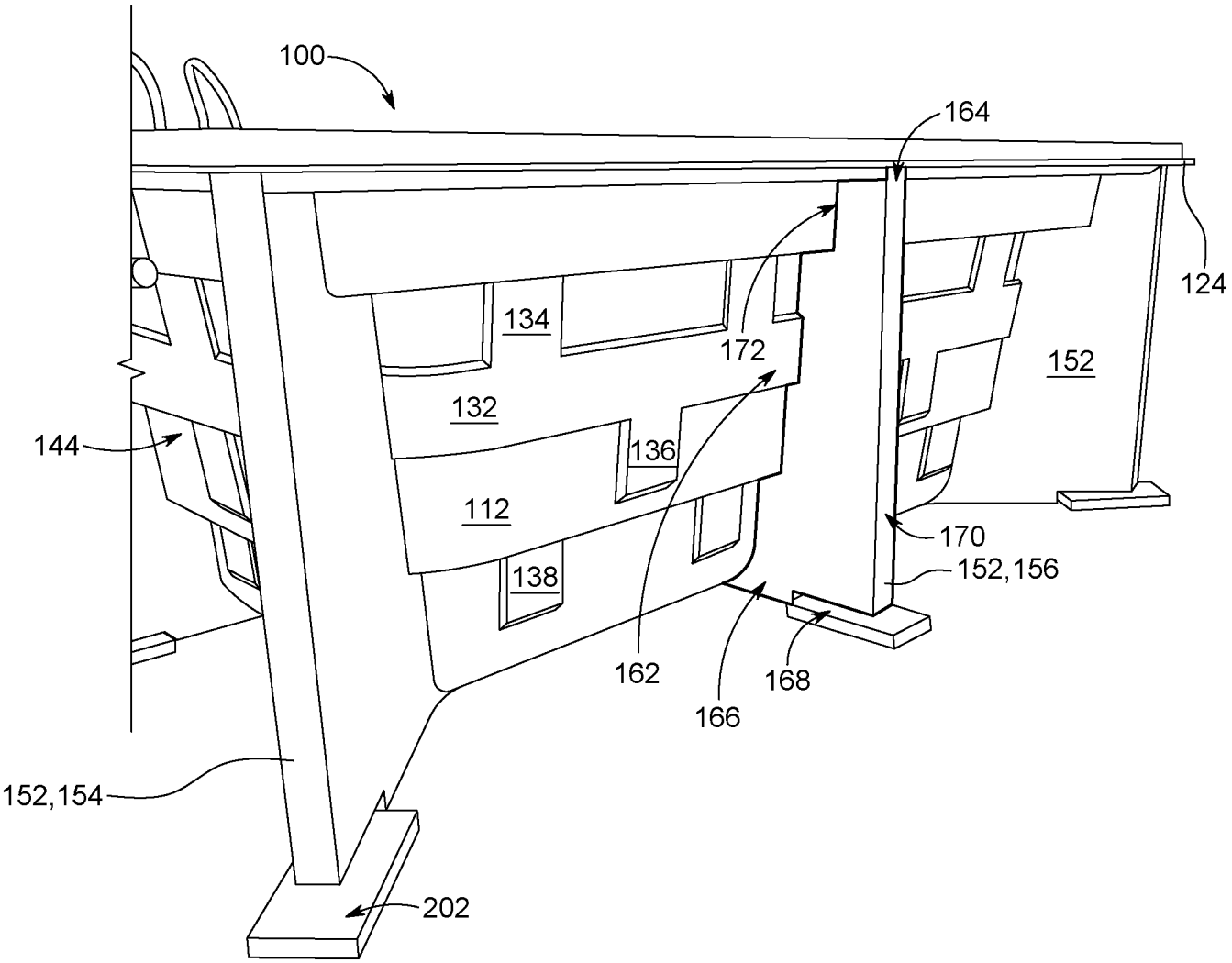
FIG. 3 is a side view of the exterior face of a wall of the pool of FIG. 1.
Figure 4:
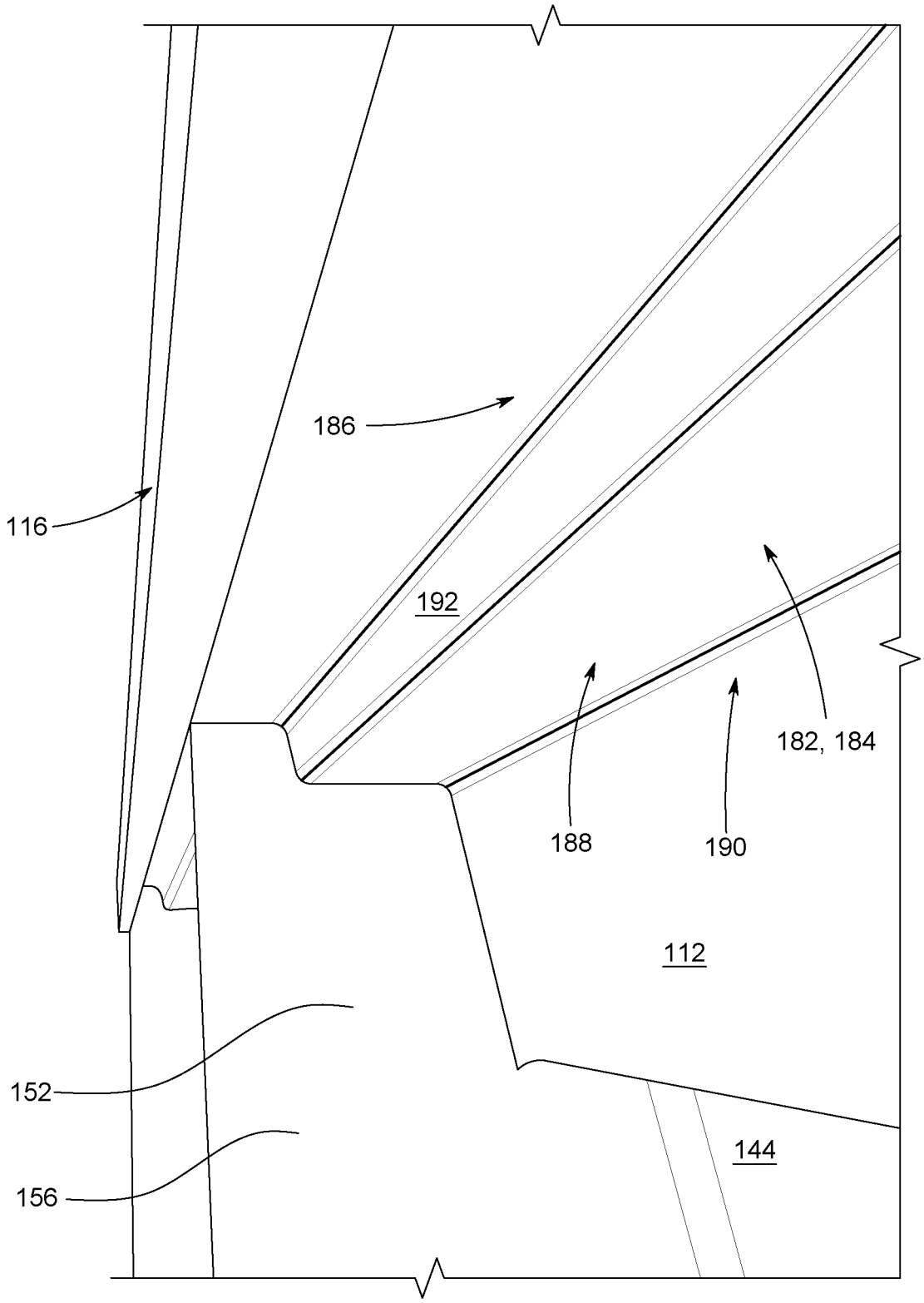
FIG. 4 is a side view of the top portion of the exterior face of a wall of the pool of FIG. 1.
Figure 5:
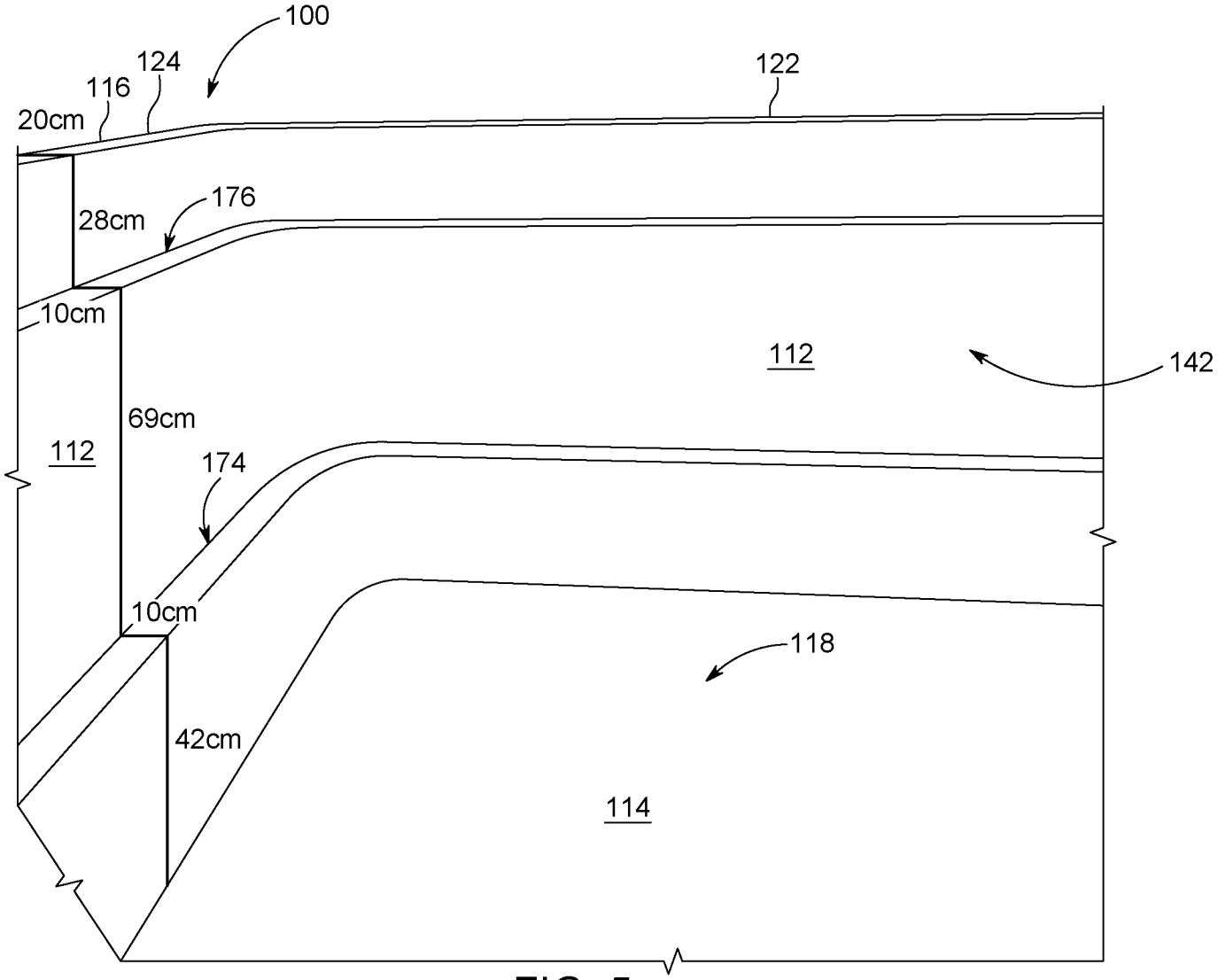
FIG. 5 is a side view of an interior face of a wall of the pool of FIG. 1.

Now referring to FIG. 3, that the middle section of the walls 112, that is the section of the walls 112 between the first step 174 and the second step 176, features on the exterior side surface 144 a reinforcement belt 132 comprising (or in selected embodiment, consisting in) an additional thickness in the wall 112 that defines a closed periphery to the walls 112, following a pattern of a horizontal band of material with additional thickness. In addition thereto, vertical reinforcements 134, perpendicularly extending from the reinforcement belt 132, (that is extending upward) and reinforcements 136, also perpendicularly extending from the reinforcement belt 132 (that is extending downward from the reinforcement belt 132), are furthermore sequentially and alternately distributed around the pool 100.

Additional thickness means that the walls (reinforcing portion or ribs excluded) is generally characterized by a first thickness, and the thicker, reinforcing portions or ribs have a second thickness which is greater than the first thickness, thereby making them thicker than the remainder of the wall.

Preferably the vertical reinforcements 134 are offset from the vertical reinforcements 136, and more precisely do not encroach upon each other according to any vertical plane drawn from the reinforcement belt 132 and perpendicular to the adjoining wall 112. Vertical, upward reinforcements 134 and vertical downward reinforcements 136, which can both be considered as ribs, are provided laterally sequentially (i.e., one after the other) and alternately (upward, downward, upward, downward, and so on) along the reinforcement belt 132, i.e., they are not in line or aligned with each other in the same line one on top of the other, said ribs originating from the reinforcement belt 132 which extends horizontally on the contour or periphery of the pool 100.

According to an embodiment, and referring to FIG. 3, the pool 100 also comprises similar ribs made of an increased thickness in the wall material, also referred to as vertical reinforcements 138, manufactured in a similar fashion, that have a certain width and that extend only downward starting from the first step 174, with the vertical reinforcements 138 also distributed on the contour of the walls 112.

The reinforcement belt 132 and the reinforcements 134, 136 and 138 are designed to provide additional resistance to the walls 112 against the outward pressure exerted by the water held in the pool 100 without the need to increase the thickness of the walls 112 all over.

It is to be noted that according to the pressure exerted over a section of a wall 112, the length of the wall 112, the distance of the section of the wall 112 from the floor 114, an additional reinforcement member 182 may be installed, e.g., in replacement to the reinforcement belt 132, thereof reinforcing the wall 112 at the determined height. Combination and nature of the reinforcement belt(s) 132 and reinforcement member(s) 182 used in the manufacture of a pool 100 is function of many factors, including the general shape of the pool 100, the volume of water the pool 100 may hold when filled to its maximum volume, the height and length of the walls 112, the shape of the walls 112, characteristics of the material, e.g., fiberglass, used to manufacture the walls 112 and floor 114, and in other similar structural component. Combination, number, position, width and thickness of the reinforcement belt(s) 132 and reinforcement member(s) 182, as the width and thickness of the reinforcement belt(s) 132, and the shape, dimensions and the material in which the reinforcement member(s) 182 are made depend on these factors. It is to be noted that the present combination of at least one of any of the reinforcement belt(s) 132 and reinforcement member(s) 182 allow to increase the size and provide additional flexibility over pools made of fiberglass, for example.

It is further to be noted that the presence of the fins 152 decrease the vertical effect of the weight of the reinforcement member 182 over the walls 112. At the contrary, the weight of the reinforcement member 182 increases the stability of the pool 100 when empty. It allows variations in the dimensions of the steps as the general slope of the walls 112.

Figure 6:
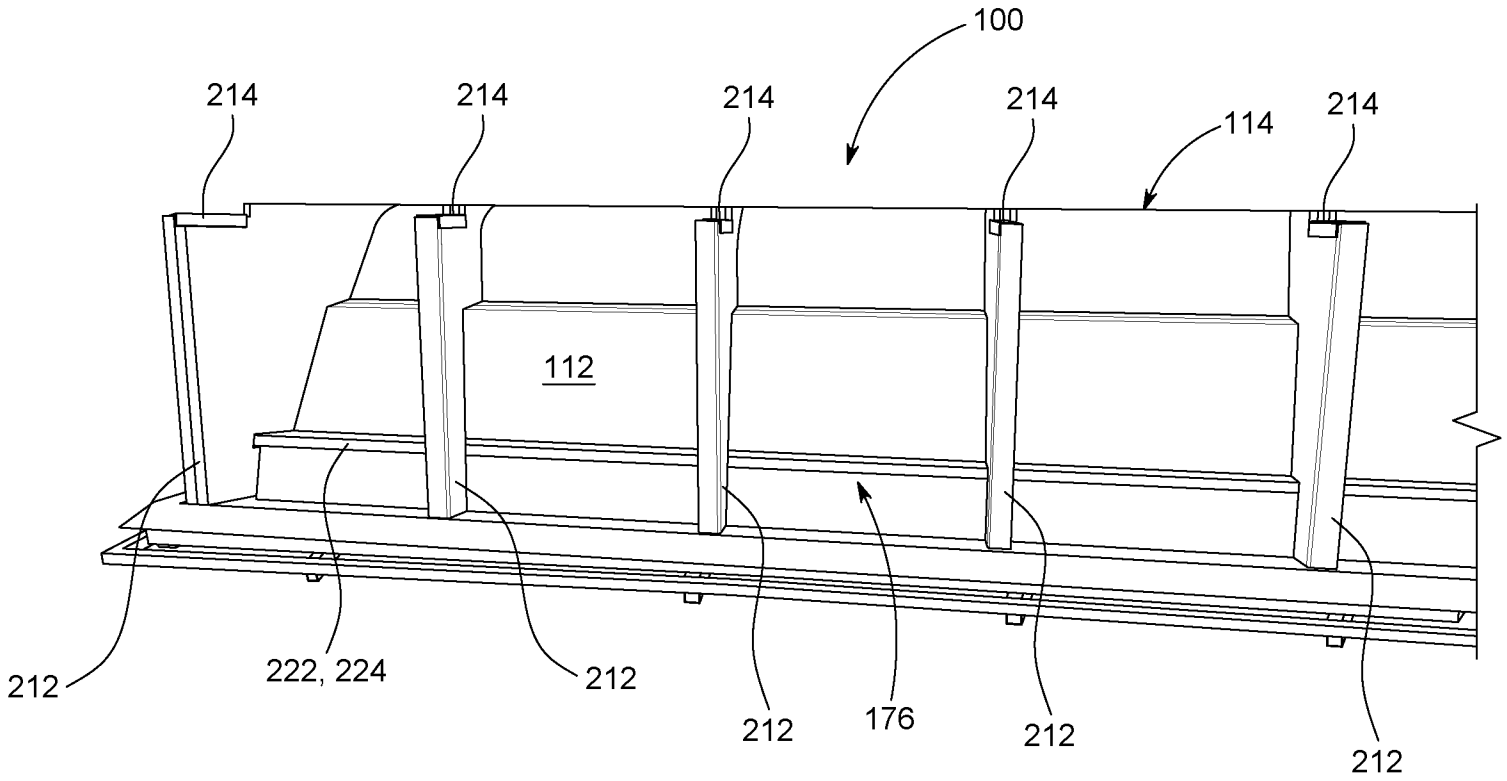
FIG. 6 is a side elevation view showing internal structure of a pool bottom-up according to an embodiment.
Figure 7:
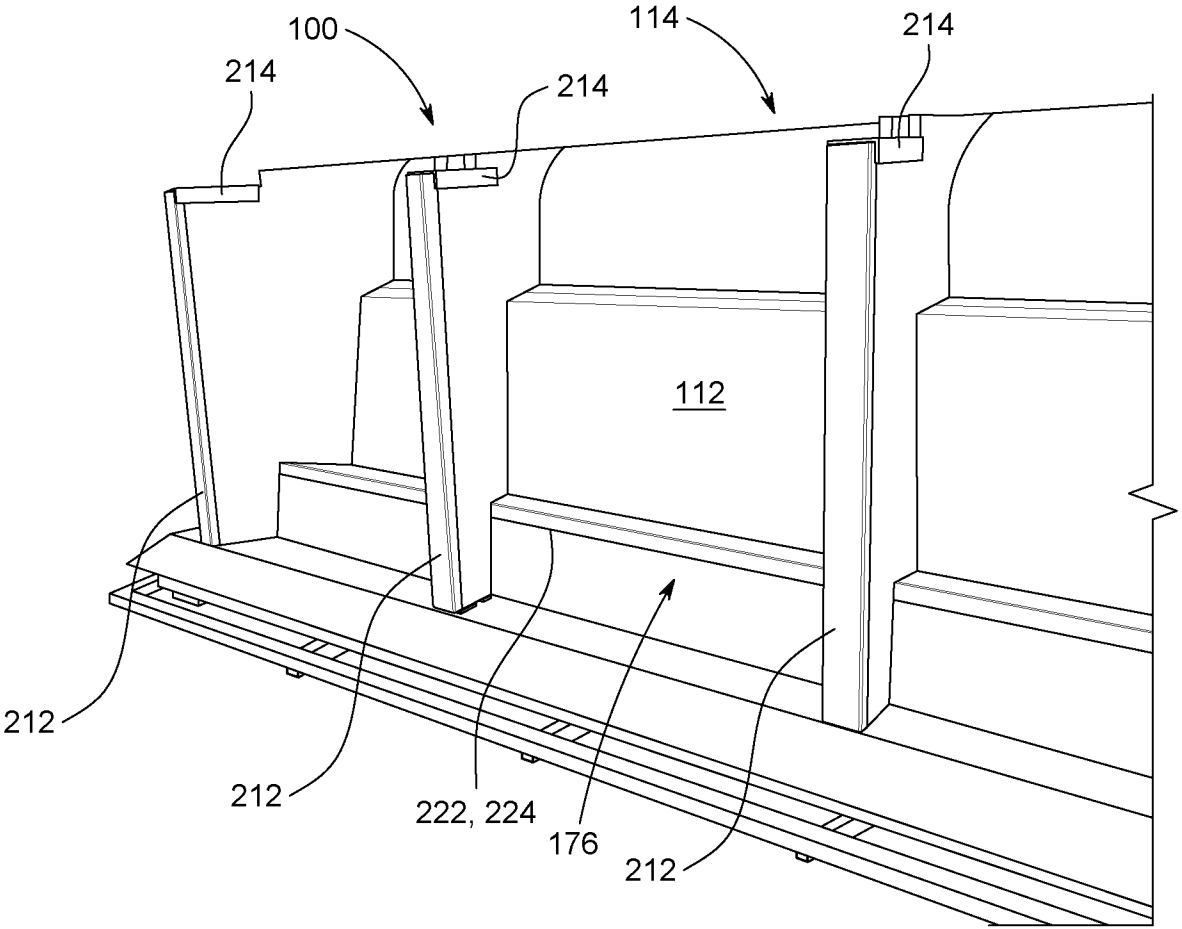
FIG. 7 oblique side elevation view showing internal structure of a pool bottom-up in accordance with an embodiment.
Figure 8:
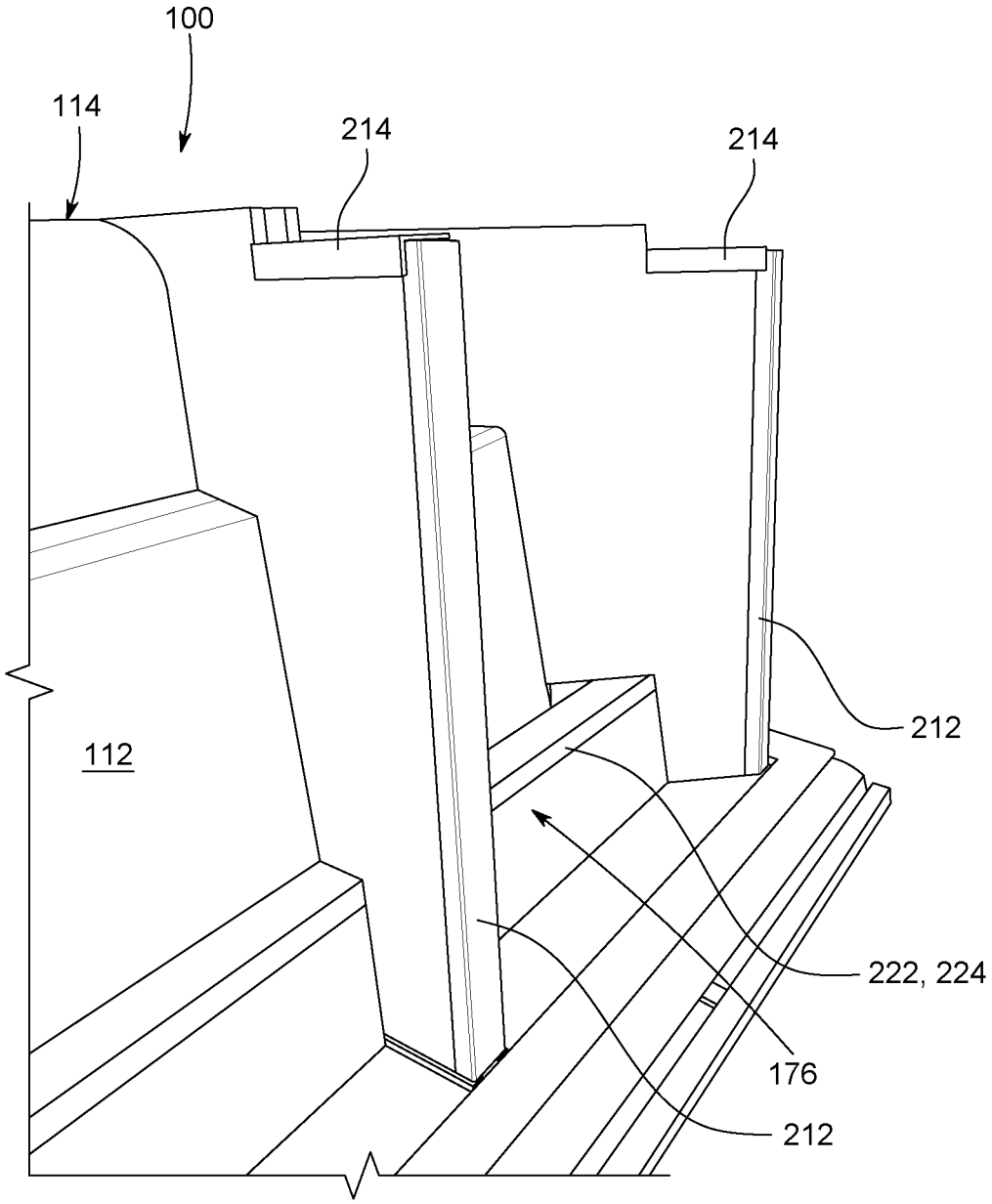
FIG. 8 is another oblique side elevation view showing internal structure of a pool bottom-up in accordance with an embodiment.

Referring now to another embodiment shown in FIGS. 6 to 8, the internal structure of the pool 100 comprises rigid internal structures 212 to be covered with fiberglass, wherein the rigid internal structures 212 are designed to provide at least some vertical support and some horizontal support in addition to the support to be provided by the covering fiberglass.

According to an embodiment, the rigid internal structure 212 is made of a combination of beams, for example and without limitation, 2"×4" wood beams, and sheet material, for example and without limitation, plywood, mounted thereto to provide the desired support in all directions.

According to an embodiment, the rigid internal structures 212 comprises reinforced feet structure 214, typically made of steel, for supporting the weight of the pool filled with water.

According to an embodiment, the pool 100 may feature one or more horizontal reinforcement 222. According to an embodiment, the one or more horizontal reinforcement 222 comprises a L-shaped fitting 224 extending from one corner fin 154 to the neighboring corner fin 154 and supported thereby and the intermediary fins 156 in-between. According to such embodiment, L-shaped fitting 224 are extending on all sides of the pool 100.

According to an embodiment, fittings 224 are installed about the top, about the top step 176. According to another embodiment, more than one horizontal reinforcements 222 are used to strengthen the pool 100, with the distance the one or more horizontal reinforcement 222 are installed from the floor 114 being function of the volume of the pool 100, the dimensions of the pool 100, the general slope of the walls 112, and the flexion/resistance to loads of the one or more horizontal reinforcement 222 in the vertical and horizontal directions.

According to another embodiment, L-shaped fittings 224 may be segmented, with each segment being supported by at least two fins 152.

According to an embodiment, L-shaped fittings 224 are made of a metallic material, in particular, they can be made of steel.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A monobloc pool comprising:

a floor;

a wall, adjoining and surrounding the floor, the floor and the wall defining together a reservoir for holding water, the wall being made of a first material providing an interior face and an exterior face, a belt extending horizontally as a closed periphery with vertical reinforcements rigidly coupled thereto, the belt and the vertical reinforcements being adapted to provide resistance against outward pressure over the reservoir, wherein the first material encloses the belt and the vertical reinforcements between the interior face and the exterior face; and fins distributed around the wall, the fins adjoining the belt, each of the fins comprising a contact face adapted for laying on the ground, thereby having the fins adapted to provide vertical support to the belt.

2. The pool of claim 1, wherein the belt is made of steel.

3. The pool of claim 2, wherein the belt is hollow.

4. The pool of claim 1, wherein the first material is fiberglass.

5. The pool of claim 1, wherein the wall is made of four wall segments.

6. The pool of claim 5, wherein the pool has a rectangular shape.

7. The pool of claim 1, wherein the wall comprises at least one tread and a plurality of risers.

8. The pool of claim 7, wherein the vertical reinforcements comprise first components extending from the belt upward over one of the plurality of risers, the first components being distant from one another.

9. The pool of claim 7, further comprising vertical reinforcements coupled to the belt, the vertical reinforcements comprising first components extending from the belt downward over one of the plurality of risers, the first components being distant from one another.

10. The pool of claim 1, wherein the wall has a first thickness distant to the belt and the vertical reinforcements and a second thickness greater than the first thickness about the belt or the vertical reinforcements.

11. The pool of claim 1, wherein the vertical reinforcements comprise first components extending downwardly from the belt and second components extending upwardly from the belt, the first components and the second components being not vertically aligned with each other.

12. The pool of claim 11, wherein the first components and the second components are extending alternatively from one another.

13. The pool of claim 1, wherein belt is made of a second material that is different from the first material.

14. The pool of claim 1, wherein the reservoir is adapted to contain a maximum volume of water when the pool is filled to its maximum filling level, and the belt is positioned at least partially below the maximum filling level.

* * * * *